US012503862B2

(12) United States Patent
Cai

(10) Patent No.: US 12,503,862 B2
(45) Date of Patent: Dec. 23, 2025

(54) ADJUSTABLE RAILING

(71) Applicant: Yubao Cai, Shenzhen (CN)

(72) Inventor: Yubao Cai, Shenzhen (CN)

( * ) Notice: Subject to any disclaimer, the term of this patent is extended or adjusted under 35 U.S.C. 154(b) by 0 days.

(21) Appl. No.: 18/901,006

(22) Filed: Sep. 30, 2024

(65) Prior Publication Data

US 2025/0354387 A1 Nov. 20, 2025

(30) Foreign Application Priority Data

May 14, 2024 (CN) ..... 202421047271.8

(51) Int. Cl.
*E04F 11/18* (2006.01)

(52) U.S. Cl.
CPC ... *E04F 11/1834* (2013.01); *E04F 2011/1821* (2013.01)

(58) Field of Classification Search
CPC ..... E04F 11/18; E04F 11/181; E04F 11/1817; E04F 11/1834; E04F 11/1836; E04F 2011/1819; E04F 2011/1821; E04H 17/1447; E04H 17/1448; E04H 17/1465; E04H 17/1488
See application file for complete search history.

(56) References Cited

U.S. PATENT DOCUMENTS

| | | | | |
|---|---|---|---|---|
| 2,715,513 | A | 8/1955 | Kools | |
| 3,339,895 | A | 9/1967 | Locke | |
| 7,232,114 | B2 * | 6/2007 | Platt | E04H 17/1413 256/65.11 |
| 7,681,866 | B2 * | 3/2010 | Lehmann | E04F 11/1834 256/65.01 |
| 7,913,983 | B1 * | 3/2011 | Sandor, Sr. | E04F 11/1812 256/60 |
| 9,322,180 | B2 * | 4/2016 | Burt | E04F 11/1836 |
| 9,470,013 | B2 * | 10/2016 | Munyon | E04F 11/1865 |
| 2005/0285091 | A1 * | 12/2005 | Ko | E04H 17/1488 256/24 |
| 2022/0290437 | A1 * | 9/2022 | Walker | E04F 11/18 |
| 2022/0290438 | A1 | 9/2022 | Timmons | |
| 2022/0396951 | A1 * | 12/2022 | Burt | E04H 17/16 |

FOREIGN PATENT DOCUMENTS

| | | | | |
|---|---|---|---|---|
| DE | 19906642 | A1 * | 8/2000 | E04F 11/1834 |
| DE | 19945564 | A1 * | 3/2001 | E04F 11/1834 |
| DE | 10154990 | A1 * | 5/2003 | E04F 11/1834 |
| DE | 102004020637 | B3 * | 11/2005 | E04F 11/1834 |
| EP | 1869268 | A1 | 12/2007 | |
| FR | 2659101 | A1 * | 9/1991 | |
| KR | 101036707 | B1 * | 5/2011 | |
| KR | 101097928 | B1 * | 12/2011 | |
| KR | 101125526 | B1 * | 3/2012 | |
| KR | 200460198 | Y1 * | 5/2012 | |
| KR | 101193141 | B1 * | 10/2012 | |

* cited by examiner

*Primary Examiner* — Jonathan P Masinick

(57) ABSTRACT

An adjustable railing includes posts and a handrail for rotational movement. A constraint section is formed on the post, enabling the connecting rods arranged between the posts to engage movably with the constraint section. This allows the adjustable railing to adaptively adjust to the ground or stair angles during on-site installation. The installation of the connecting rods does not require individual screws for tightening, reducing the number of components and saving installation time. This adjustable railing features a simple structure with reliable component interaction, enhancing the installation efficiency and flexibility for personnel in the field.

7 Claims, 21 Drawing Sheets

ADJUSTABLE RAILING

CROSS REFERENCE OF RELATED APPLICATIONS

This application claims priority of Chinese Patent Application No. 202421047271.8, filed on May 14, 2024, entitled "Adjustable Railing," in the China National Intellectual Property Administration (CNIPA), the entire contents of which is hereby incorporated by reference in its entireties.

TECHNICAL FIELD

This disclosure relates to the field of railing devices, specifically to an adjustable railing.

BACKGROUND OF THE INVENTION

Railings, as common protective devices along roads and stair edges, feature a simple structure and ease of installation. With increasing attention to safety in public spaces and home walking areas, railing devices are widely used along road edges and stairways. However, due to varying site conditions, especially differing stair slopes, many installations rely on railing fabricators to conduct on-site measurements or obtain site information through other means before processing the railings. This reliance renders railings non-standard components, which limits their applicability to certain sites and often requires custom fabrication, leading to challenges in reuse and high processing costs. This situation restricts consumer choices and the expansion of manufacturing capabilities. Particularly for merchants utilizing sales models like direct selling or blind selection, developing railing products that can adaptively fit various stair and ground slopes without requiring consumers to provide measurements is a significant and practical research topic. While some existing railing structures allow for relative rotation of handrails and posts to accommodate different slopes, these products still necessitate additional connecting rods to enhance structural strength between posts, often requiring custom lengths or separate welding of the connecting rods. This situation can affect installation efficiency and increase operational complexity. Therefore, enhancing the adaptability of railings to stair or site slopes while further improving installation convenience and efficiency remains a critical and meaningful challenge.

SUMMARY OF THE INVENTION

In view of this, the purpose of this disclosure is to provide an adjustable railing with a simple structure, easy installation, and the ability to adapt to stair or installation site slopes.

To achieve the above technical purpose, the technical solution adopted by this disclosure is to provide an adjustable railing.

The adjustable railing includes a handrail and posts. The handrail is arranged horizontally or inclined. The posts are more than two and are spaced apart below the handrail along the length direction of the handrail. The upper ends of the posts are rotatably connected to the underside of the handrail. The lower ends of the posts are designed to connect with external supports to support the handrail. The adjustable railing also includes a connecting rod.

More than one connecting rod are arranged between adjacent posts. Each post has a constraint section designed to cooperate with the connecting rods. The constraint section includes a clearance opening located on the post for the connecting rod to pass through. The two ends of the connecting rod pass through the clearance openings of the posts adjacent to the connecting rod, and are movably connected to the constraint sections of the posts.

Additionally, either ends of each connecting rod are connected to a limit member, which prevent the ends of the connecting rod from exiting the constraint section.

In this disclosure, the movable connection between the connecting rod and the constraint section of the post includes rotational connections and connections that can axially move within a certain range.

As a possible embodiment, further, the connecting rods are parallel to the handrail.

As a possible embodiment, further, when the posts rotate relative to the handrail, the connecting rods can rotate around the limit members at their ends.

As a possible embodiment, further, the posts have a tubular structure, with the surrounding wall of the clearance opening, the internal cavity, and the section for accommodating the connecting rod designated as the constraint section.

As a possible embodiment, further, the bottom of the posts includes a connecting base.

As a possible embodiment, further, one, two, three, or more connecting rods are arranged between each adjacent pair of posts; when there are more than two connecting rods between adjacent posts, the connecting rods are arranged in a spaced manner from top to bottom.

Based on the above structure, as a preferred embodiment, the horizontal width of the clearance opening is greater than the width of the ends of the connecting rod but less than the width of the side walls of the post.

As one optional structural embodiment of the limit member, the limit member is preferably a limit pin, with both ends fixed to the side walls of the constraint section on either side of the post;

Correspondingly, the end of the connecting rod that passes through the constraint section is equipped with a limit groove that cooperates with the limit pin. The limit groove has a U-shaped structure, with one end extending axially along the connecting rod and forming an opening. When the end of the connecting rod enters the constraint section, the limit pin enters the limit groove at the end of the connecting rod through the opening, allowing the connecting rod to rotate around the limit pin.

As a second optional structural embodiment of the limit member, the limit member is preferably a U-shaped spring clip, with limit protrusions on the sides of the open ends.

Correspondingly, the end of the connecting rod that passes through the constraint section is equipped with a receiving cavity. The U-shaped spring clip is placed within the receiving cavity. Corresponding through-holes are provided on the opposite side walls of the receiving cavity for the limit protrusions of the U-shaped spring clip to pass through, extending out of the receiving cavity and rising above the outer wall of the connecting rod.

Additionally, the posts of this disclosure have one of the following structures:

(1) The side walls of the constraint section of the post are equipped with limit holes that correspond to the limit protrusions; when the end of the connecting rod passes into the constraint section, the portion of the limit protrusion that extends beyond the outer wall of the connecting rod enters the limit hole, allowing the connecting rod to rotate freely within the constraint section;

(2) The lower part of the clearance opening of the post has a tapered structure; the width of this tapered structure is greater than the width of the end of the connecting rod but less than the sum of the width of the end of the connecting rod and the height of the limit protrusion above the outer wall of the connecting rod. The width of the upper part of the clearance opening is greater than the sum of the width of the end of the connecting rod and the height of the limit protrusion. The end of the connecting rod passes through the upper part of the clearance opening into the upper part of the constraint section and is constrained by the limit protrusions of the U-shaped spring clip in conjunction with the tapered structure at the lower part of the constraint section.

As a third optional structural embodiment of the limit member, the limit member is preferably a limit rod; the limit rod is inserted into the end of the connecting rod that passes through the constraint section, with both ends extending out from either side of the connecting rod, rising above the outer wall of the connecting rod;

Correspondingly, the lower part of the clearance opening of the post has a tapered structure; the width of this tapered structure is greater than the width of the end of the connecting rod but less than the sum of the width of the end of the connecting rod and the heights of both ends of the limit rod above the outer wall of the connecting rod. The width of the upper part of the clearance opening is greater than the sum of the width of the end of the connecting rod and the heights of both ends of the limit rod above the outer wall of the connecting rod. The end of the connecting rod passes through the upper part of the clearance opening into the constraint section, and is constrained by the limit rod in conjunction with the tapered structure at the lower part of the constraint section.

As a fourth optional structural embodiment of the limit member, the limit member includes a bracket.

The bracket has an open-top box-like shell structure and is fixedly mounted at the lower part of the constraint section of the post. The side of the bracket opposite to the clearance opening of the constraint section has a penetration opening for the end of the connecting rod to pass through. The upper part of the bracket adjacent to the penetration opening has two sides extending upwards to form an opening, creating a lap joint groove, which is either V-shaped or U-shaped;

Correspondingly, the ends of the connecting rod that pass through the constraint section have raised portions. The end of the connecting rod enters the upper part of the constraint section through the upper part of the clearance opening and is movably engaged with the lap joint groove via the raised portions.

As a preferred embodiment choice, the bracket has one or more of the following structures:

(1) A water guide plate is installed inclinedly in the lower part of the bracket; the inclined lower side of the water guide plate extends to the outer side of the bracket where the penetration opening is located or beyond that outer side;

(2) The lower part of the outer side of the bracket with the penetration opening is equipped with a connecting skirt; a slot is formed between the connecting skirt and the outer side of the bracket with the penetration opening; the bracket is secured to the lower part of the constraint section of the post by inserting the slot over the lower edge of the clearance opening.

Compared with the prior art, the advantage of this disclosure are as follows: this disclosure cleverly connects the post and the handrail in a rotational manner, provides a constraint section on the post, and enables active cooperation with connecting rods positioned between the posts. This allows the adjustable railing to adaptively adjust to the slope of the ground or stairs during installation by adjusting the position of the posts, handrail, and connecting rods. The installation of the connecting rods does not require tightening individual screws, reducing the number of components and saving installation time. This adjustable railing not only has a simple structure but also features reliable cooperation among its components, enhancing the efficiency and flexibility of on-site installation personnel.

BRIEF DESCRIPTION OF DRA WINGS

DETAILED DESCRIPTION OF THE INVENTION

Figure 1:
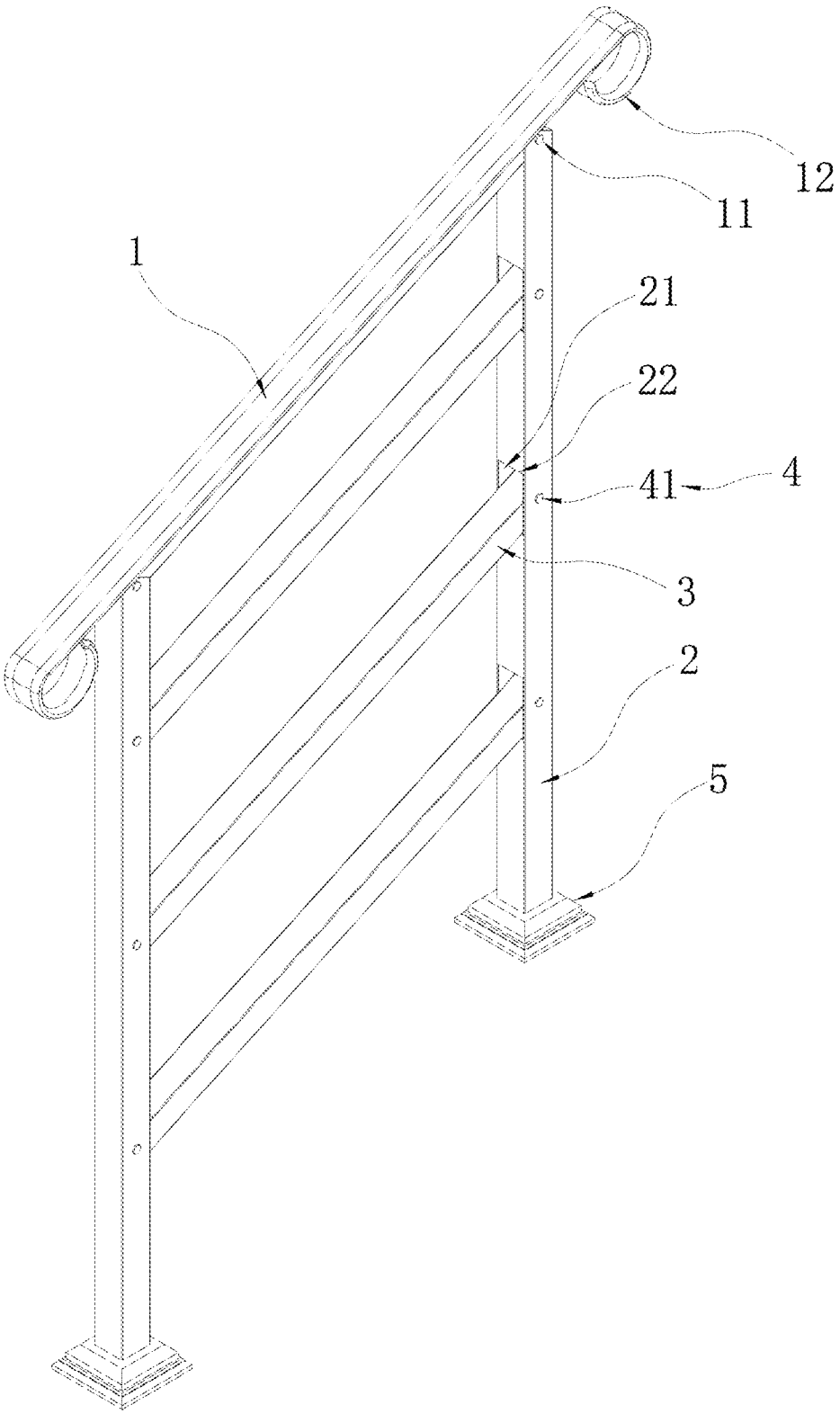
FIG. 1 is a perspective view illustrating a simplified structure of the first embodiment of this solution.

Below, with reference to the accompanying drawings and embodiments, further detailed descriptions of the present disclosure are provided.

Embodiment 1

As shown in FIGS. 1 to 4, this embodiment provides an adjustable railing, which includes a handrail 1 and posts 2. The handrail 1 is arranged horizontally or at an incline. The posts 2 are provided in pairs or more and are spaced below the handrail 1 along its length. The upper ends of the posts 2 are rotatably connected to the underside of the handrail 1, which can be achieved through a rotating shaft 11 or other connection components. The lower ends of the posts 2 are connected to external supports (e.g., stairs, ground) to support the handrail 1. Additionally, this adjustable railing includes connecting rods 3.

The connecting rods 3 are arranged between adjacent posts 2. The posts 2 are equipped with constraint sections 21 for cooperating with the connecting rods 3. The constraint section 21 includes a clearance opening 22 for the connecting rods 3 to pass through. Either ends of the connecting rods 3 pass through the corresponding clearance openings 22 in the adjacent posts 2 and are movably connected to the constraint section 21 of the posts 2.

The ends of the connecting rods 3 are also connected to limit members 4, which prevent the ends of the connecting rods 3 from exiting the constraint section 21. When the posts 2 rotate relative to the handrail 1, the connecting rods 3 can rotate around the limit members 4 at their ends.

To facilitate the adaptive adjustment of the connecting rods 3 during railing installation, the connecting rods 3 are arranged parallel to the handrail 1.

Additionally, as a possible embodiment, the posts 2 may have a tubular structure; the walls surrounding the clearance opening 22, the inner cavity, and the portions that fit with the connecting rods 3 are designated as the constraint section. In this embodiment, the connecting rods 3 have a rectangular tubular structure.

To facilitate the installation of the posts 2 at the usage site, as another possible embodiment, the bottom of the posts 2 is equipped with a connecting base 5. This connecting base 5 is used to secure the posts to external supports, such as the stairs or ground where the railing is installed.

Regarding the quantity of posts 2 and connecting rods 3, in this embodiment, two posts 2 are shown. The number of connecting rods 3 between adjacent posts 2 is three. However, between adjacent posts 2, there may also be one, two, etc. When there are more than two connecting rods 3 between adjacent posts 2, the connecting rods 3 are arranged in a spaced manner from top to bottom between the adjacent posts 2.

Based on the above structure, preferably, the horizontal width of the clearance opening 22 on the posts 2 is greater than the width of the end of the connecting rods 3 and less than the width of the side wall of the posts 2.

Figure 2:
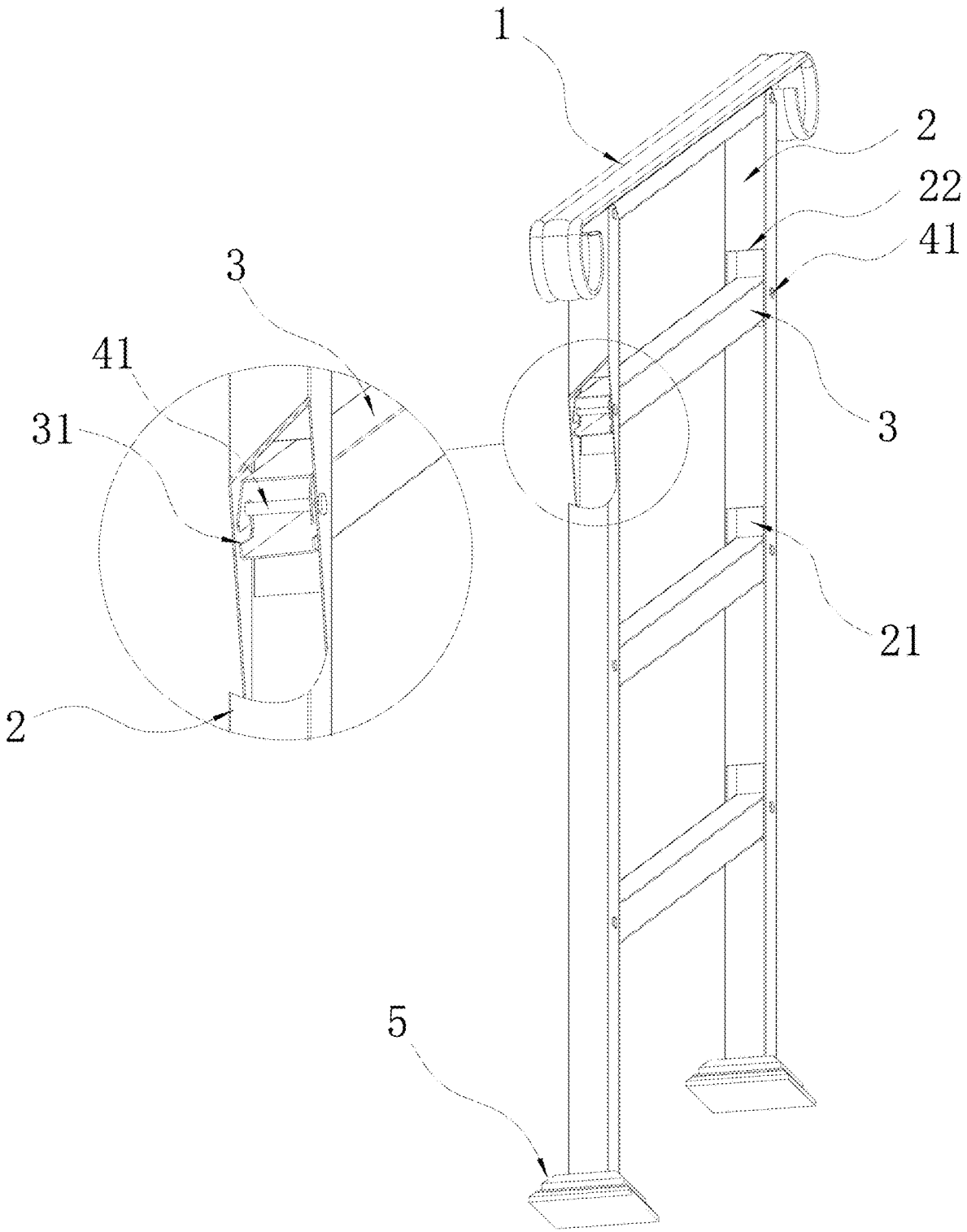
FIG. 2 is a perspective view illustrating another simplified structure of the first embodiment of this solution, showing a partial cross-section and enlargement of the connection between the connecting rod and the post.
Figure 3:
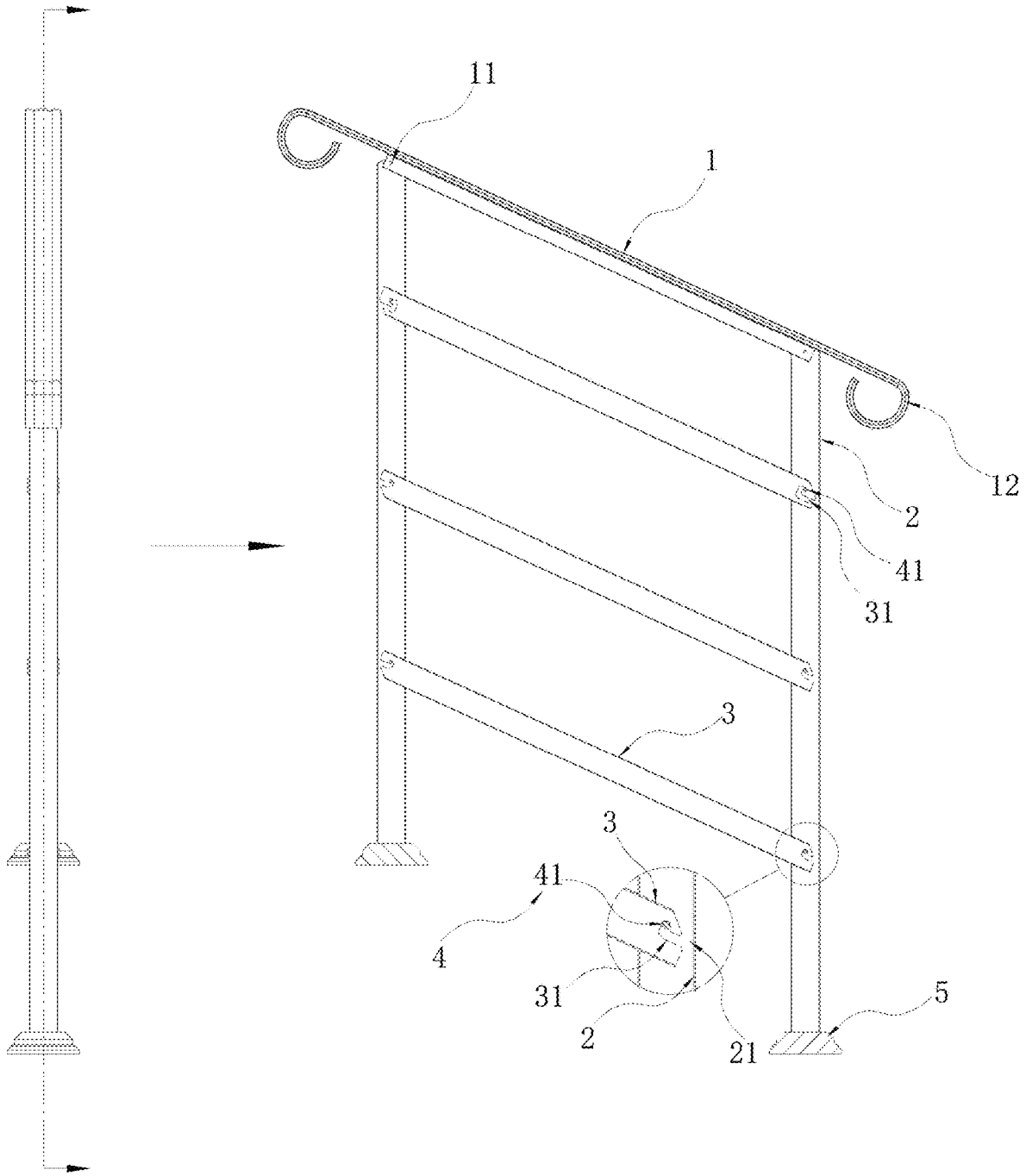
FIG. 3 is a side cross-sectional view of the simplified structure of the first embodiment of this solution.
Figure 4:
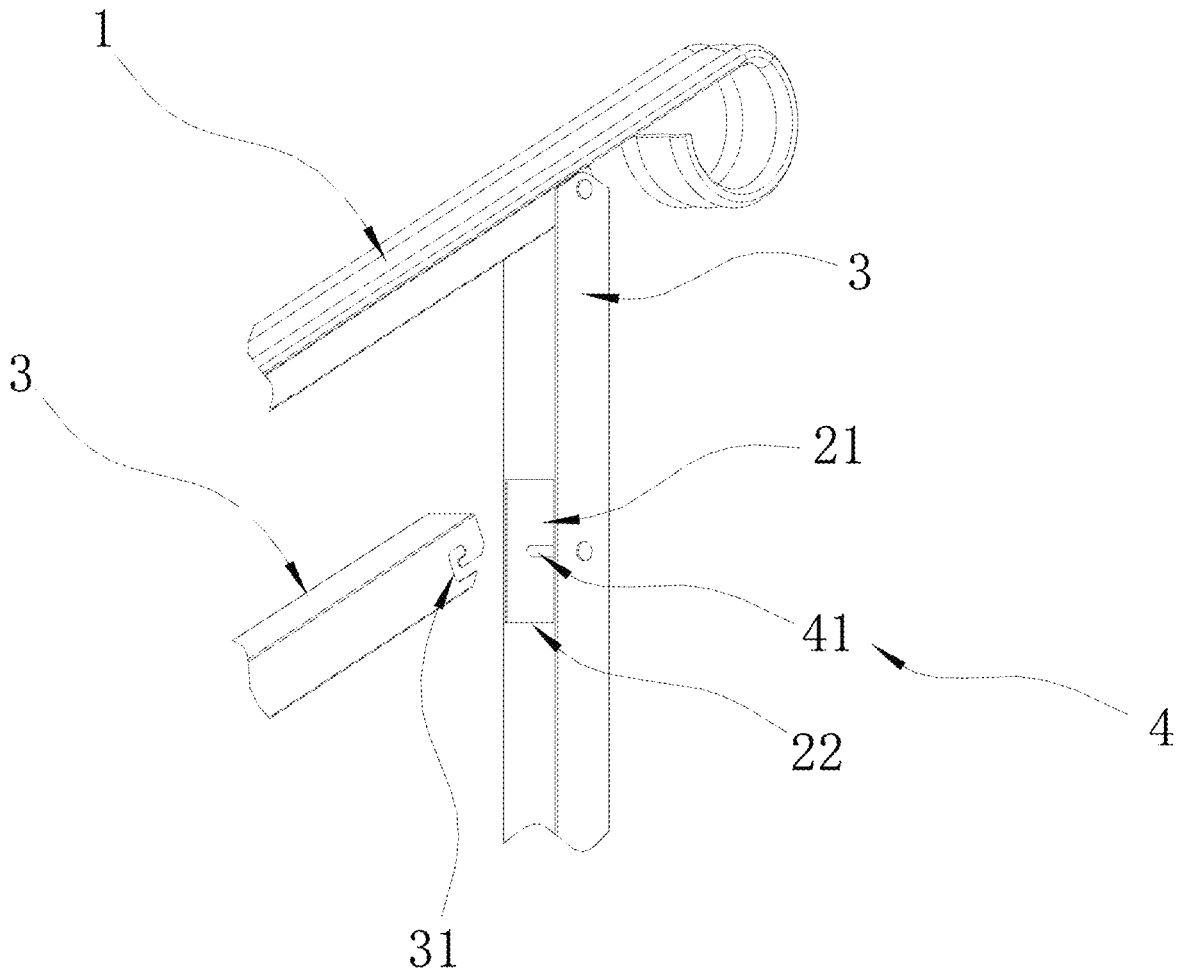
FIG. 4 is an exploded view illustrating the simplified cooperation between the handrail, post, and connecting rod of the first embodiment.
Figure 5:
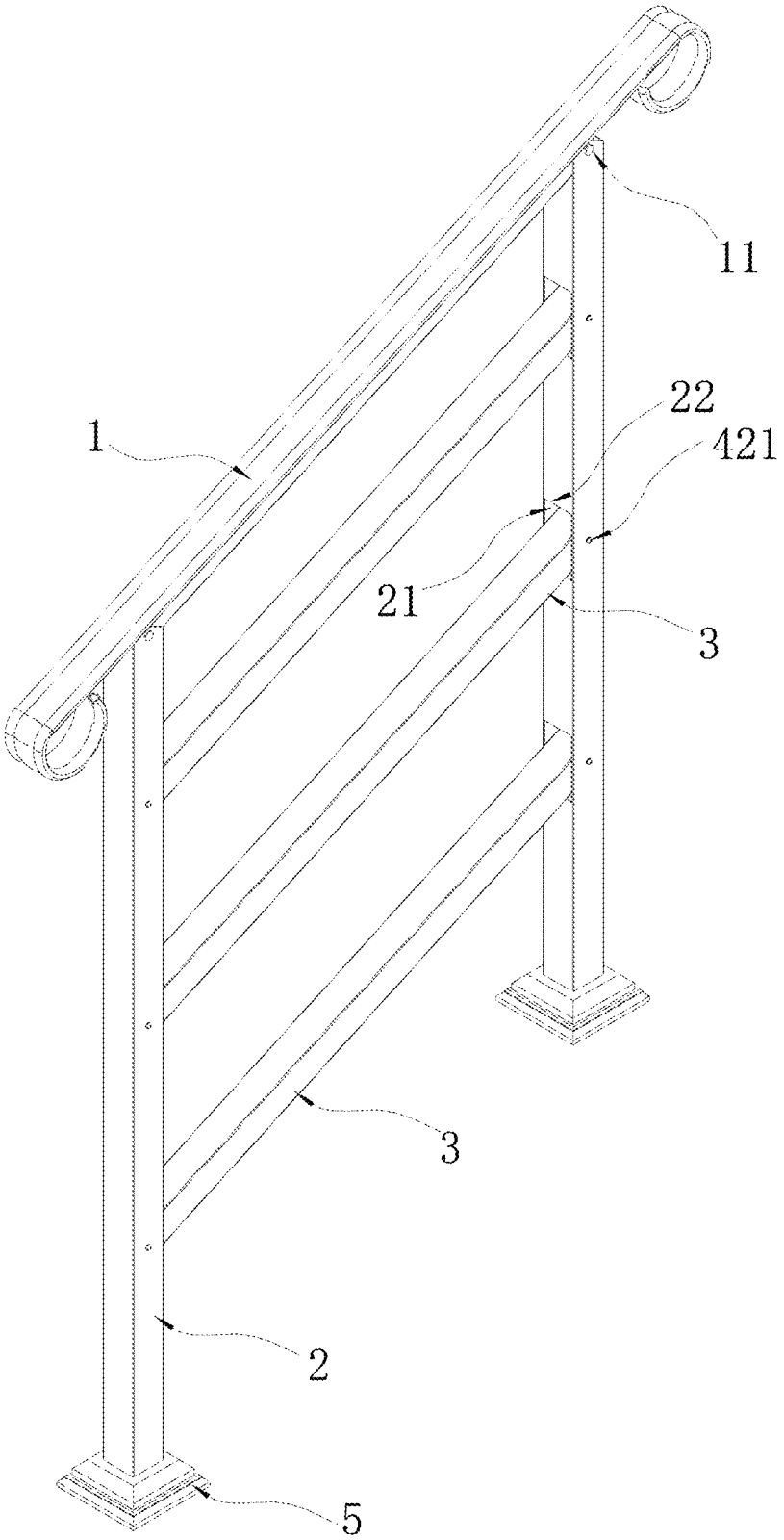
FIG. 5 is a perspective view illustrating a simplified structure of the second embodiment of this solution.

Focusing on FIGS. 2, 3, and 4, as one optional embodiment structure for the limiting component 4, it is preferred that the limiting component 4 is a limiting pin 41; both ends of the limiting pin 41 are fixed to the side walls on both sides of the constraint section 21 of the posts 2.

Accordingly, the end of the connecting rods 3 that penetrates into the constraint section 21 is equipped with a limiting groove 31 that fits with the limiting pin 41; the limiting groove 31 has a U-shaped structure. One end of the U-shaped structure extends along the axial end of the connecting rods 3 and forms an open end. When the end of the connecting rods 3 penetrates into the constraint section 21, the limiting pin 41 enters the limiting groove 31 at the end of the connecting rods 3 through the open end, allowing the connecting rods 3 to rotate around the limiting pin 41 while being engaged with it.

In this solution, the limiting pin 41 rotationally constrains the end of the connecting rods 3 within the constraint section 21 of the posts 2. This allows the adjustable railing to adaptively adjust the angle between the adjacent posts 2 and the handrail 1 according to the slope of the installation area when installed on stairs or uneven surfaces. As the posts 2 and handrail 1 rotate relative to each other, the connecting rods 3 also adaptively follow the rotation, meaning they rotate around their connection point with the limiting pin 41 to accommodate the installation of the posts 2 and handrail 1. With this structure, the handrail 1, posts 2, and connecting rods 3 can all be adjusted in angle before final installation, significantly improving the installation efficiency for workers. Furthermore, this adaptability allows for broader applicability of the adjustable railing, enabling manufacturers to produce them in larger quantities.

Embodiment 2

As shown in FIGS. 5 to 8, this embodiment proposes an adjustable railing that includes a handrail 1 and posts 2. The handrail 1 can be arranged horizontally or at an angle. There are two or more posts 2 spaced below the handrail 1 along its length. The upper ends of the posts 2 are rotatably connected to the underside of the handrail 1 through a rotating shaft 11 or other connecting components. The lower ends of the posts 2 connect to an external support structure (e.g., stairs or the ground) to support the handrail 1. Additionally, this adjustable railing includes:

One or more connecting rods 3 positioned between adjacent posts 2. Each post 2 has a constraint section 21 that facilitates the connection with the connecting rods 3. The constraint section 21 includes a clearance opening 22 located on the post 2 through which the connecting rods 3 can pass. The ends of the connecting rods 3 pass through the clearance openings 22 of their respective adjacent posts 2 and are dynamically connected to the constraint section 21 of the posts 2.

Furthermore, each end of the connecting rods 3 is equipped with a limiting member 4 to prevent the ends from exiting the constraint section 21. When the posts 2 rotate relative to the handrail 1, the connecting rods 3 can rotate along with the limiting members 4 at their ends.

To facilitate the adaptive adjustment of the connecting rods 3 during railing installation, the connecting rods 3 are parallel to the handrail 1.

Additionally, as a possible embodiment, the posts 2 are designed as tubular structures; the wall, internal cavity, and the portion that accommodates the connecting rods 3 around the clearance opening 22 are configured as the constraint section. In this embodiment, the connecting rods 3 have a rectangular tubular structure.

To simplify the installation of the posts 2 at the site, further, the bottom of each post 2 is equipped with a connecting base 5 for fixing to external support structures, such as the stairs or ground where the railing is installed.

Specifically, in this embodiment, there are two illustrated posts 2, with three connecting rods 3 placed between adjacent posts 2. The horizontal width of the clearance opening 22 on the posts 2 is greater than the width of the ends of the connecting rods 3 and less than the width of the side walls of the posts 2.

In this embodiment, most structural features are similar to those in Example 1, with the key difference being the design of the limit element.

Figure 6:
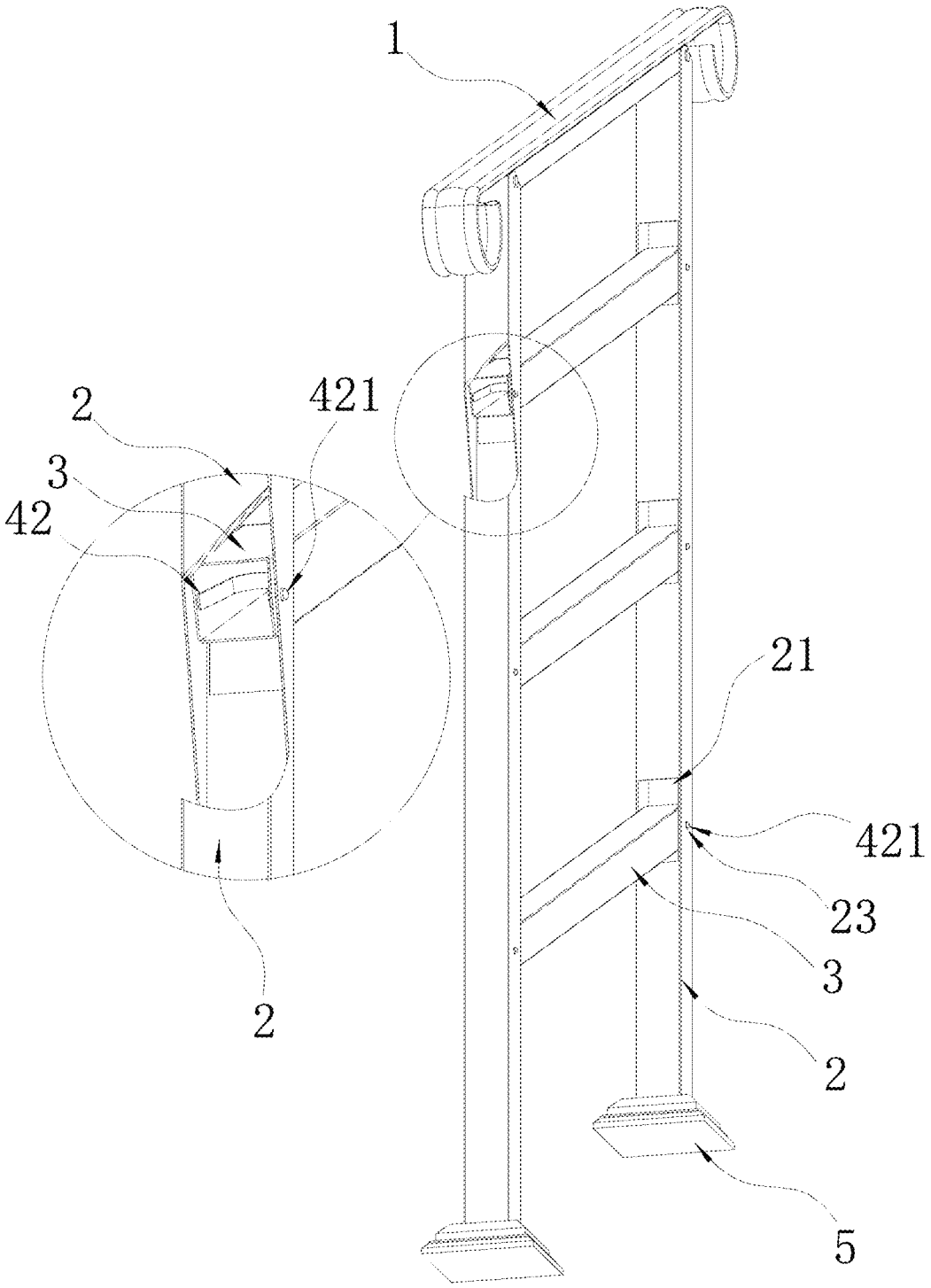
FIG. 6 is a perspective view illustrating another simplified structure of the second embodiment of this solution, showing a partial cross-section and enlargement of the connection between the connecting rod and the post.
Figure 7:
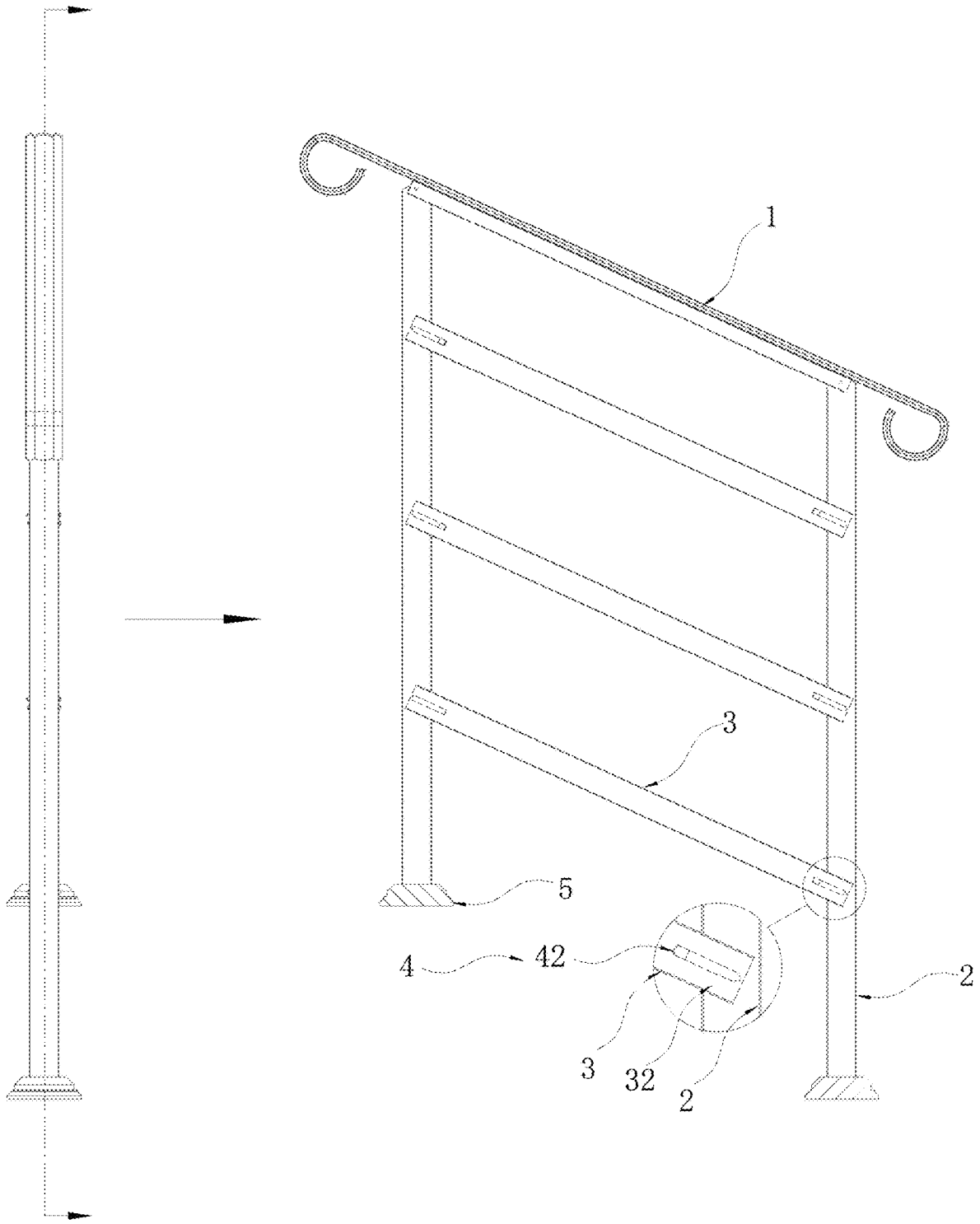
FIG. 7 is a side cross-sectional view of the simplified structure of the second embodiment of this solution.
Figure 8:
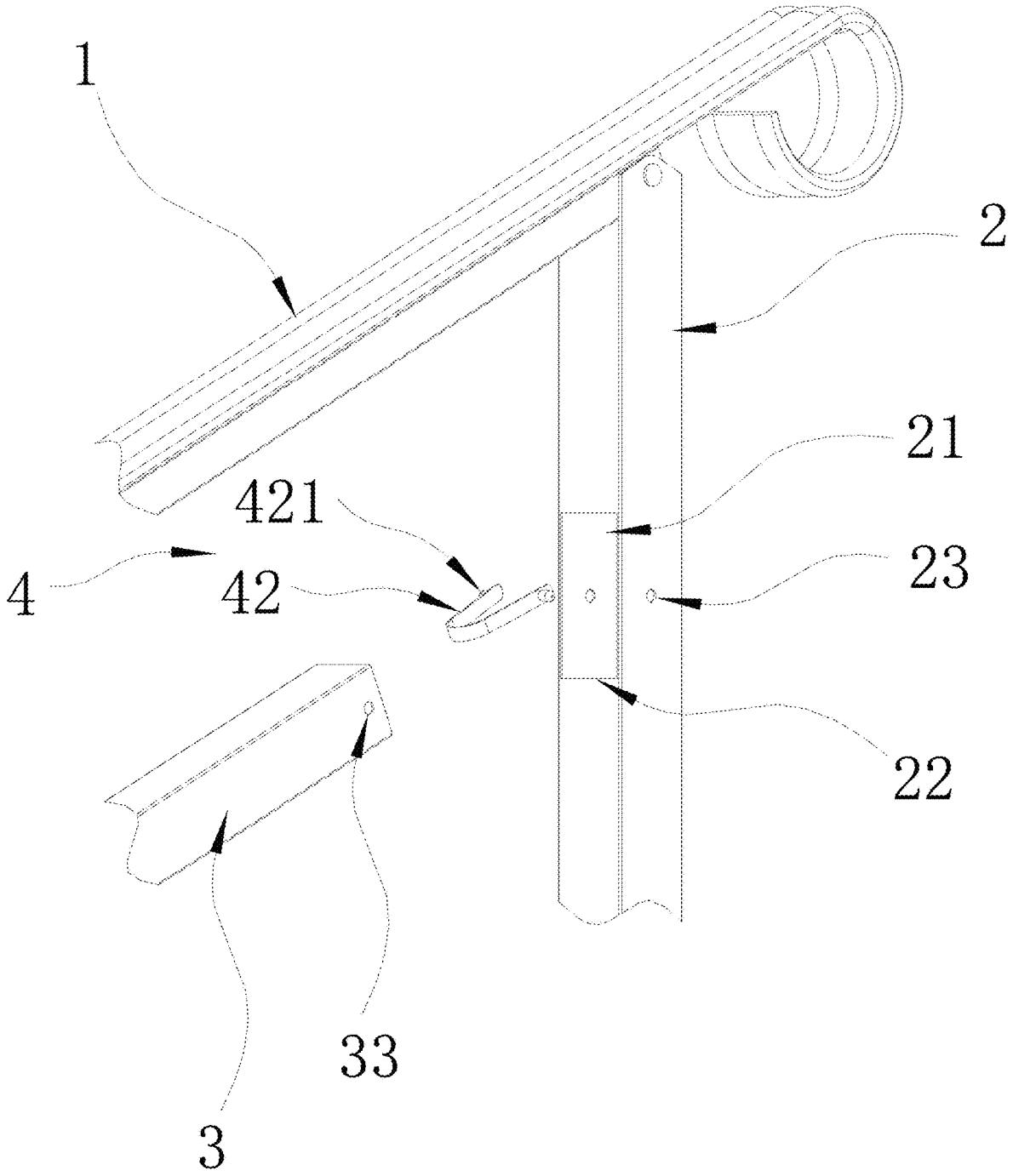
FIG. 8 is an exploded view illustrating the simplified cooperation between the handrail, post, and connecting rod of the second embodiment.
Figure 9:
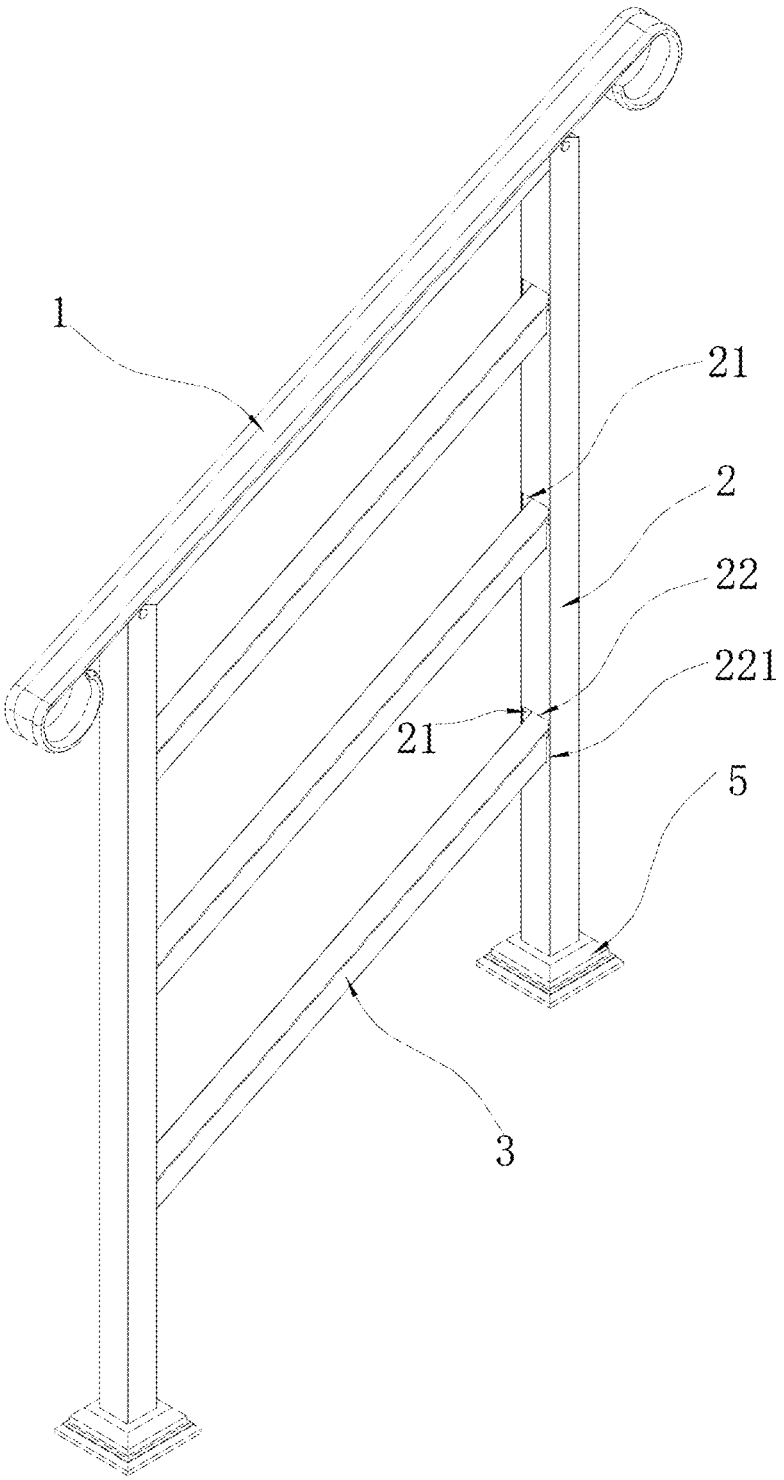
FIG. 9 is a perspective view illustrating a simplified structure of the third embodiment of this solution.

Specifically, as illustrated in FIGS. 6, 7, and 8, the limit element 4 in this embodiment is preferably a U-shaped spring clip 42. Both ends of the U-shaped spring clip 42 have a limiting projection 421 on the sides that are spaced apart.

Correspondingly, the connecting rod 3 has a receiving cavity 32 at the end that passes through the constraint section 21. The U-shaped spring clip 42 is positioned within the receiving cavity 32. One of the opposing side walls of the receiving cavity 32 has through holes 33 corresponding to the limiting projections 421 of the U-shaped spring clip 42. The limiting projections extend through the through holes, protruding beyond the outer wall of the connecting rod 3.

Based on this structure, the side walls of the constraint section 21 of the posts 2 are equipped with limit holes 23 that correspond to the limiting projections 421. When the end of the connecting rod 3 passes into the constraint section 21, the portion of the limiting projection 421 that extends beyond the outer wall of the connecting rod 3 fits into the limit hole 23, allowing the connecting rod 3 to rotate and be movably constrained within the constraint section 21.

In this embodiment, the limiting projection 421 of the U-shaped spring clip 42 and the limit hole 23 on the post 2 constrain the end of the connecting rod 3 within the constraint section 21 of the post 2. This allows the adjustable railing to adaptively adjust the angle between adjacent posts 2 and the railing 1 when installed on stairs or uneven surfaces. During the relative rotation of the post 2 and the railing 1, the connecting rod 3 also follows the rotation, meaning it rotates around the interaction point between the limiting projection 421 and the limit hole 23 to accommodate the installation of the post 2 and railing 1. Compared to Example 1, the U-shaped spring clip 42 can be manually installed in the receiving cavity 32 of the connecting rod 3 during on-site assembly, exposing the limiting projection 421 outside the through hole 33. When the connecting rod 3 is inserted into the constraint section 21, the limiting projection 421 is compressed by the side walls of the constraint section 21, allowing it to retract into the through hole 33. When the limiting projection 421 aligns with the limit hole 23, it pops out and fits into the limit hole 23 to complete the connection.

Embodiment 3

As shown in FIGS. 9 to 12, most of the structural embodiments of this adjustable railing are similar to those in Implementation Example 2. The adjustable railing includes a handrail 1, posts 2, connecting rods 3, limiting members 4, and a connection seat 5, with the overall structural cooperation being largely the same, so it will not be reiterated here.

Unlike the solution in Implementation Example 2, the matching structure of the post 2 and the U-shaped spring clip 42 as the limiting member 4 differs in this embodiment.

Figure 10:
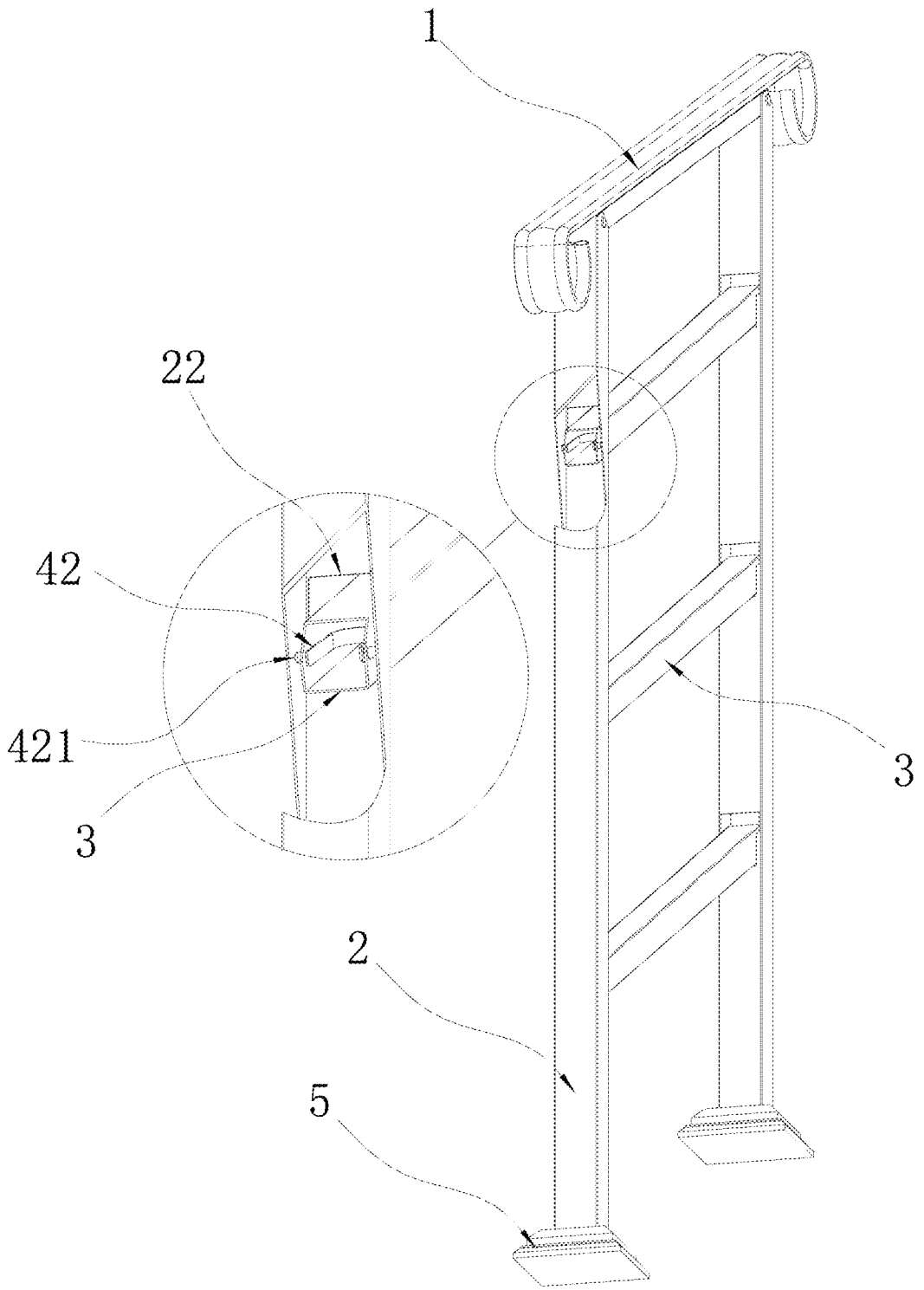
FIG. 10 is a perspective view illustrating another simplified structure of the third embodiment of this solution, showing a partial cross-section and enlargement of the connection between the connecting rod and the post.
Figure 11:
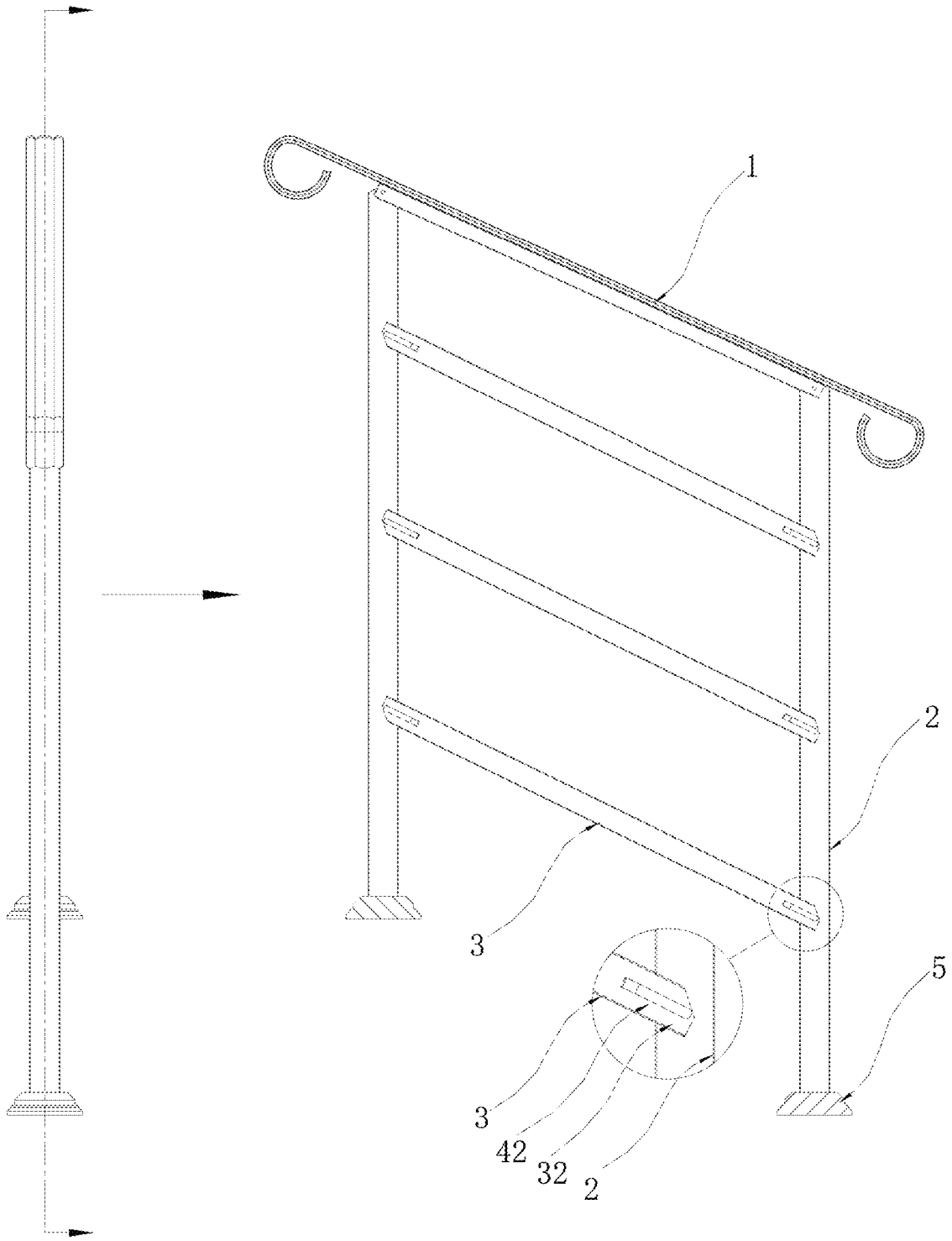
FIG. 11 is a side cross-sectional view of the simplified structure of the third embodiment of this solution.
Figure 12:
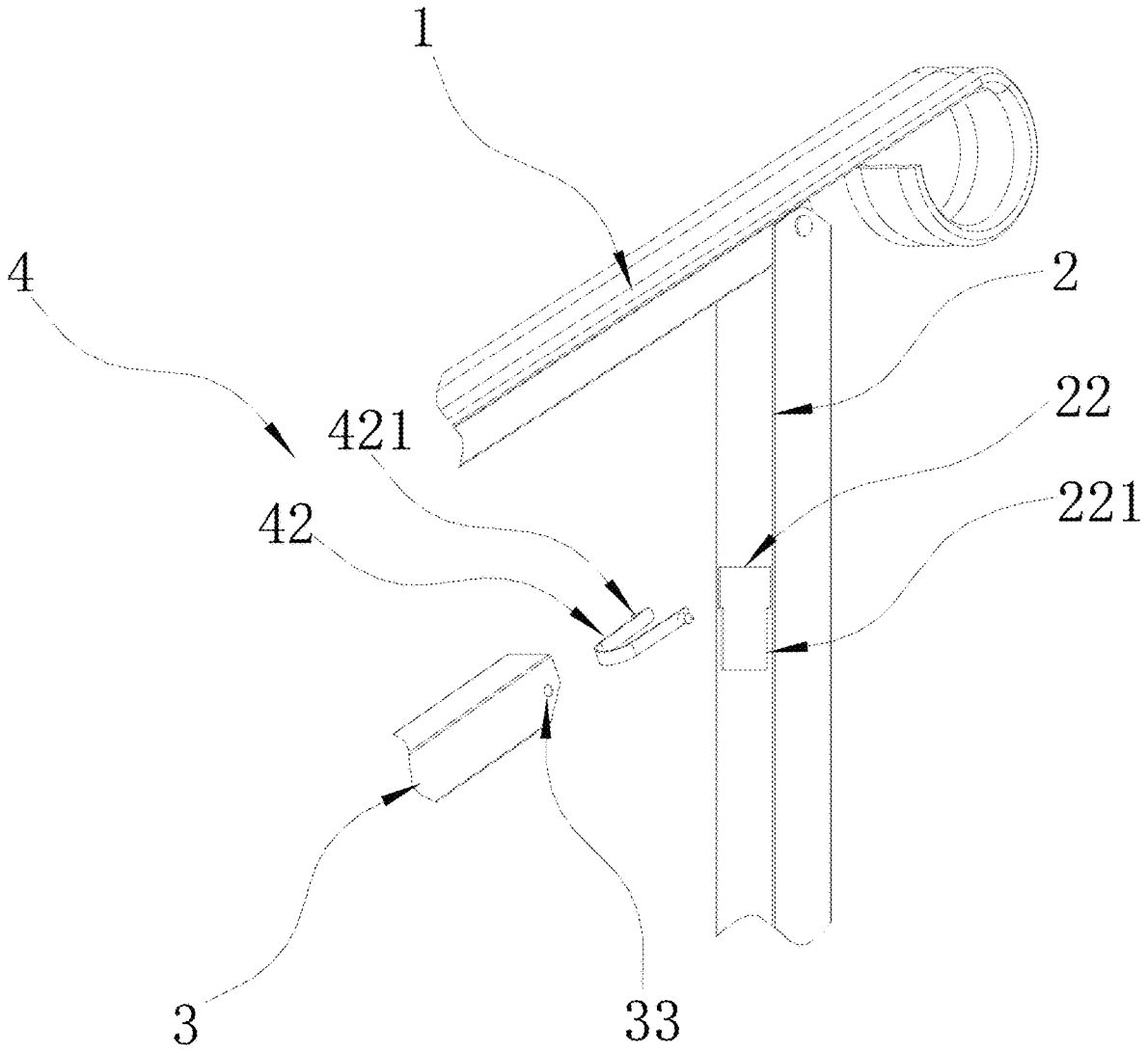
FIG. 12 is an exploded view illustrating the simplified cooperation between the handrail, post, and connecting rod of the third embodiment.
Figure 13:
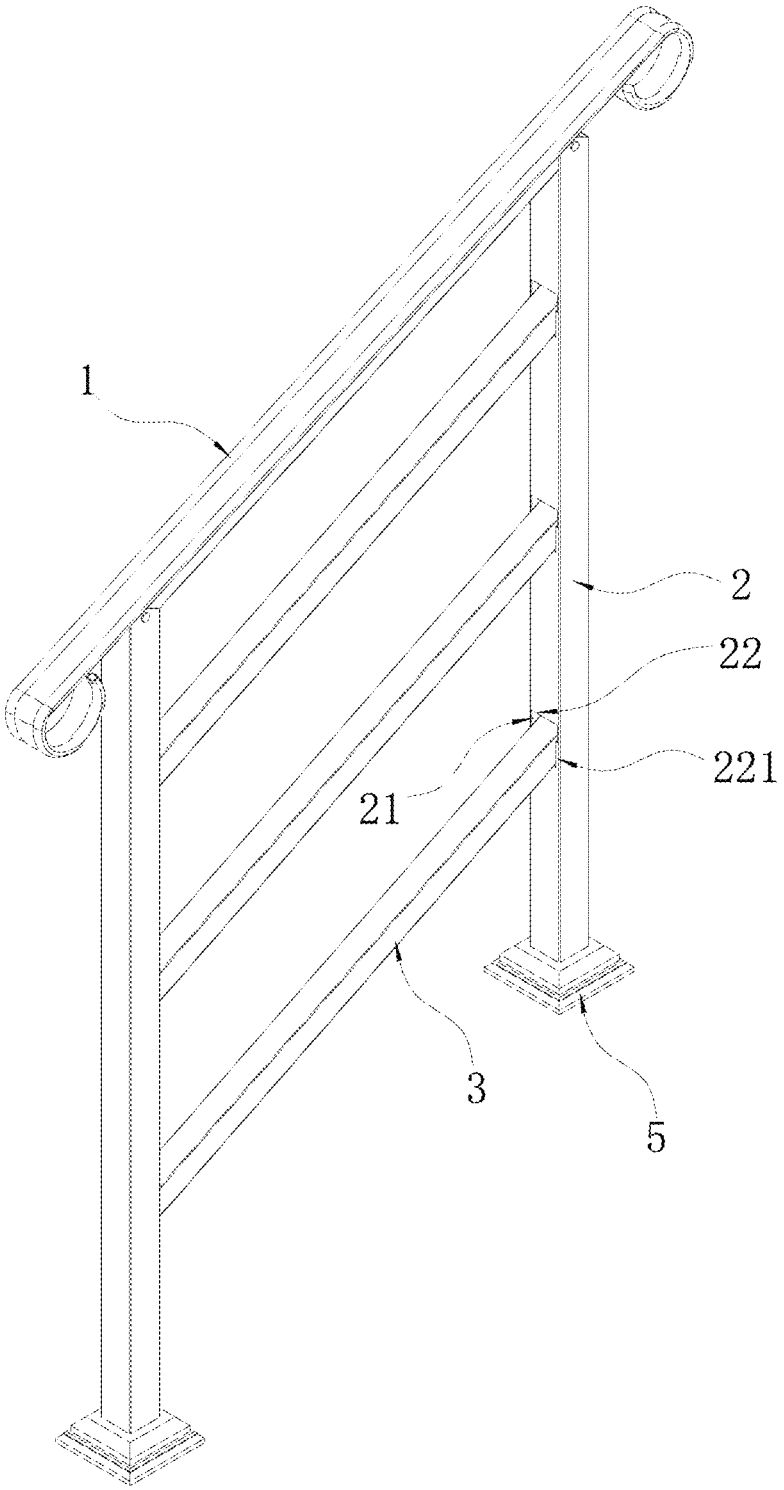
FIG. 13 is a perspective view illustrating a simplified structure of the fourth embodiment of this solution.

Specifically, as shown in FIGS. 10, 11, and 12, the limiting member 4 is a U-shaped spring clip 42 that has limiting projections 421 on both sides.

Correspondingly, the connecting rod 3 has a receiving cavity 32 at its end that penetrates the constraint section 21. The U-shaped spring clip is placed within the receiving cavity 32. The opposing side walls of the receiving cavity 32 have through holes 33 corresponding to the limiting projections of the U-shaped spring clip. The limiting projections 421 extend through the through holes 33 from the receiving cavity 32 and are positioned above the outer wall of the connecting rod 3.

In terms of the matching structure with the U-shaped spring clip 42, the lower part of the clearance opening 22 on the post 2 is a tapering structure 221. The width of this tapering structure 221 is greater than the width of the end of the connecting rod 3 but less than the sum of the width of the end of the connecting rod 3 and the height of the limiting projection 421 above the outer wall of the connecting rod 3. The upper part of the clearance opening 22 on the post 2 has a width greater than the sum of the width of the end of the connecting rod 3 and the height of the limiting projection 421 above the outer wall of the connecting rod 3.

Based on the above structure, during installation, the end of the connecting rod 3 enters the upper part of the constraint section 21 through the upper part of the clearance opening 22. It is constrained in conjunction with the tapering structure 221 at the lower part of the clearance opening 22 via the limiting projection 421 of the U-shaped spring clip 42. That is, when the connecting rod 3 is inserted into the constraint section 21, it is lowered by its own weight or the pulling force of the installer, causing the limiting projection 421 of the U-shaped spring clip 42 to extend beyond the side wall of the connecting rod 3, forming a constraint structure to prevent the connecting rod 3 from disengaging from the constraint section 21. Under this structure, the connecting rod 3 can not only rotate within a certain range but also has some space to move axially.

Compared to Implementation Example 2, in this solution, the end of the connecting rod 3 is additionally constrained by the tapering structure 221 at the lower part of the clearance opening 22 when interfacing with the constraint section 21 of the post 2. In this embodiment, the end of the connecting rod 3 can rotate and has axial movement space, providing greater adaptability for the connecting rod 3 during installation of the adjustable railing.

Embodiment 4

As shown in FIGS. 13 to 16, the adjustable railing of this embodiment shares a similar structure with those of Embodiments 1, 2, and 3. The adjustable railing includes a handrail 1, a post 2, a connecting rod 3, a limiting member 4, and a connecting seat 5, with an overall configuration that is also similar, which will not be elaborated further.

Unlike the structures in Embodiments 1, 2, and 3, the limiting member 4 in this embodiment has a different configuration, and the interaction between the post 2 and the limiting member 4 is also different.

Figure 14:
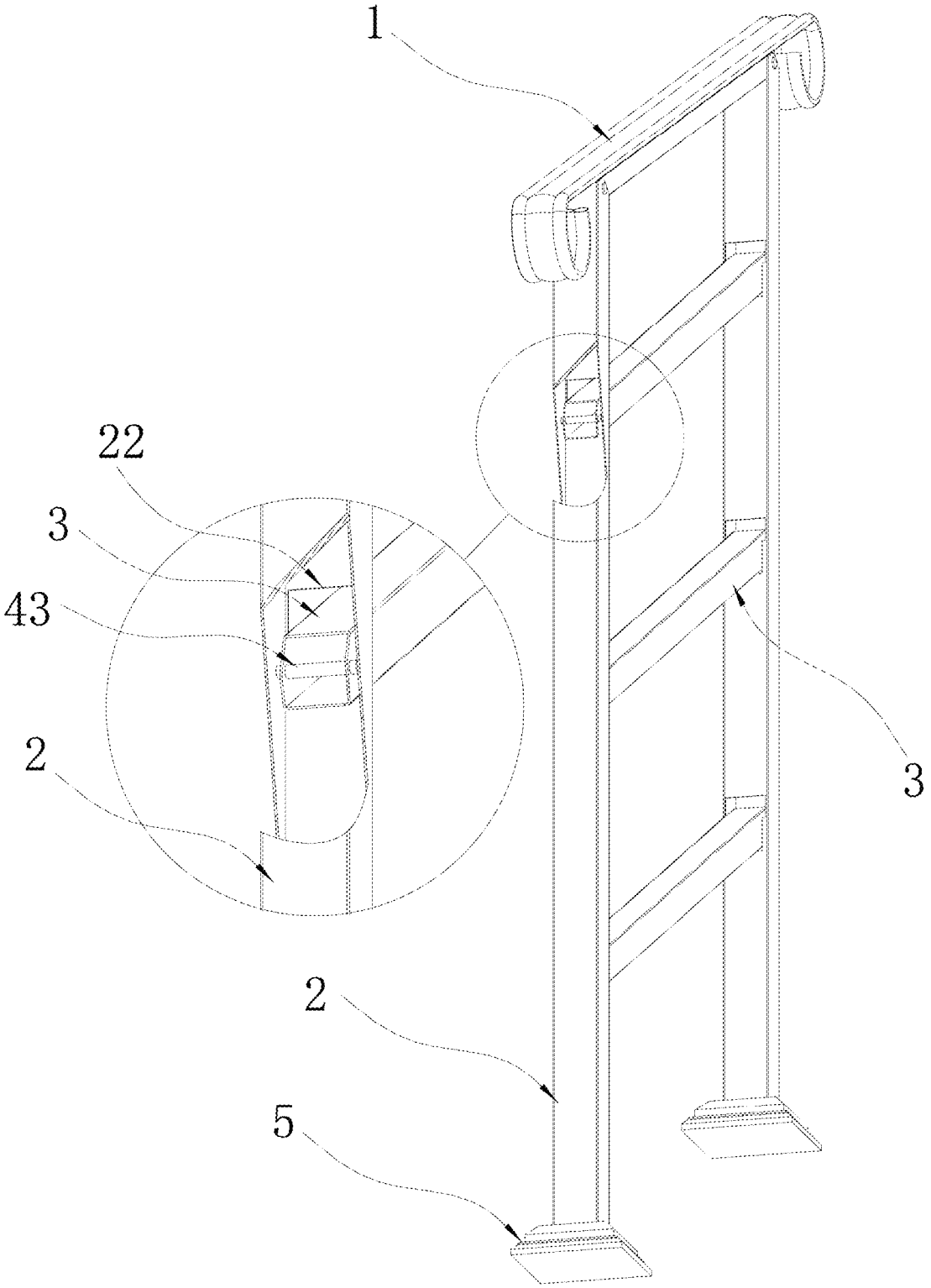
FIG. 14 is a perspective view illustrating another simplified structure of the fourth embodiment of this solution, showing a partial cross-section and enlargement of the connection between the connecting rod and the post.
Figure 15:
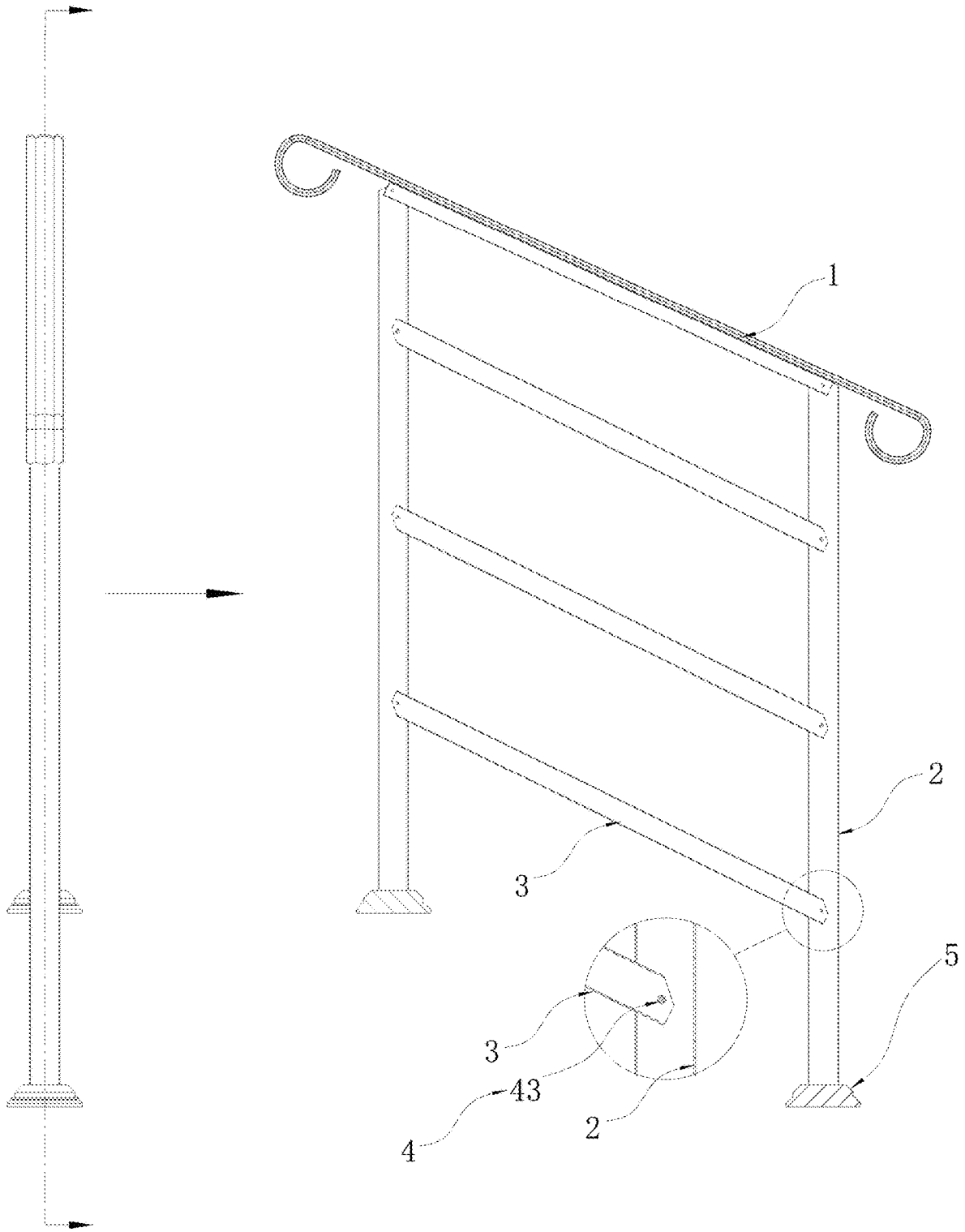
FIG. 15 is a side cross-sectional view of the simplified structure of the fourth embodiment of this solution.
Figure 16:
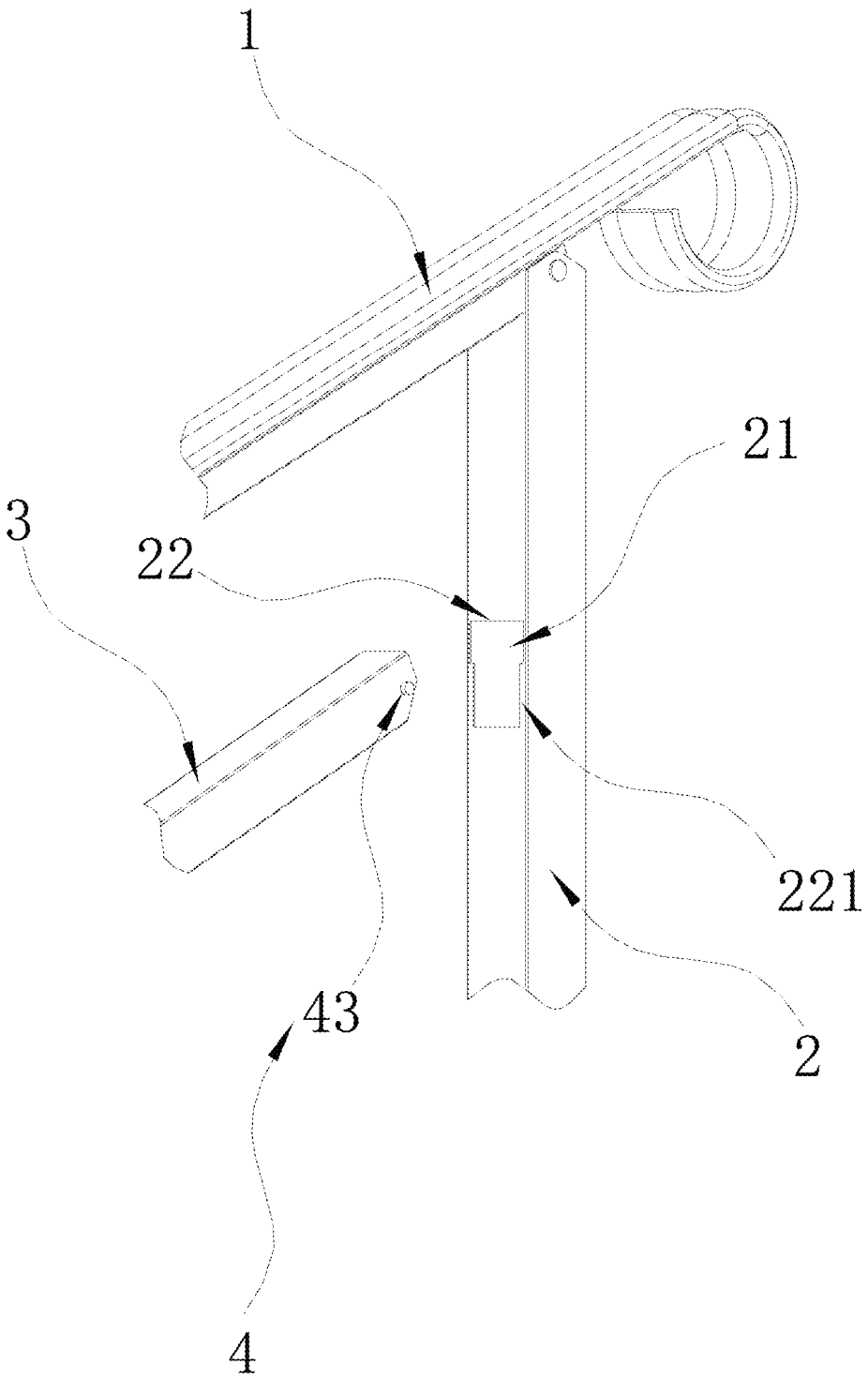
FIG. 16 is an exploded view illustrating the simplified cooperation between the handrail, post, and connecting rod of the fourth embodiment.
Figure 17:
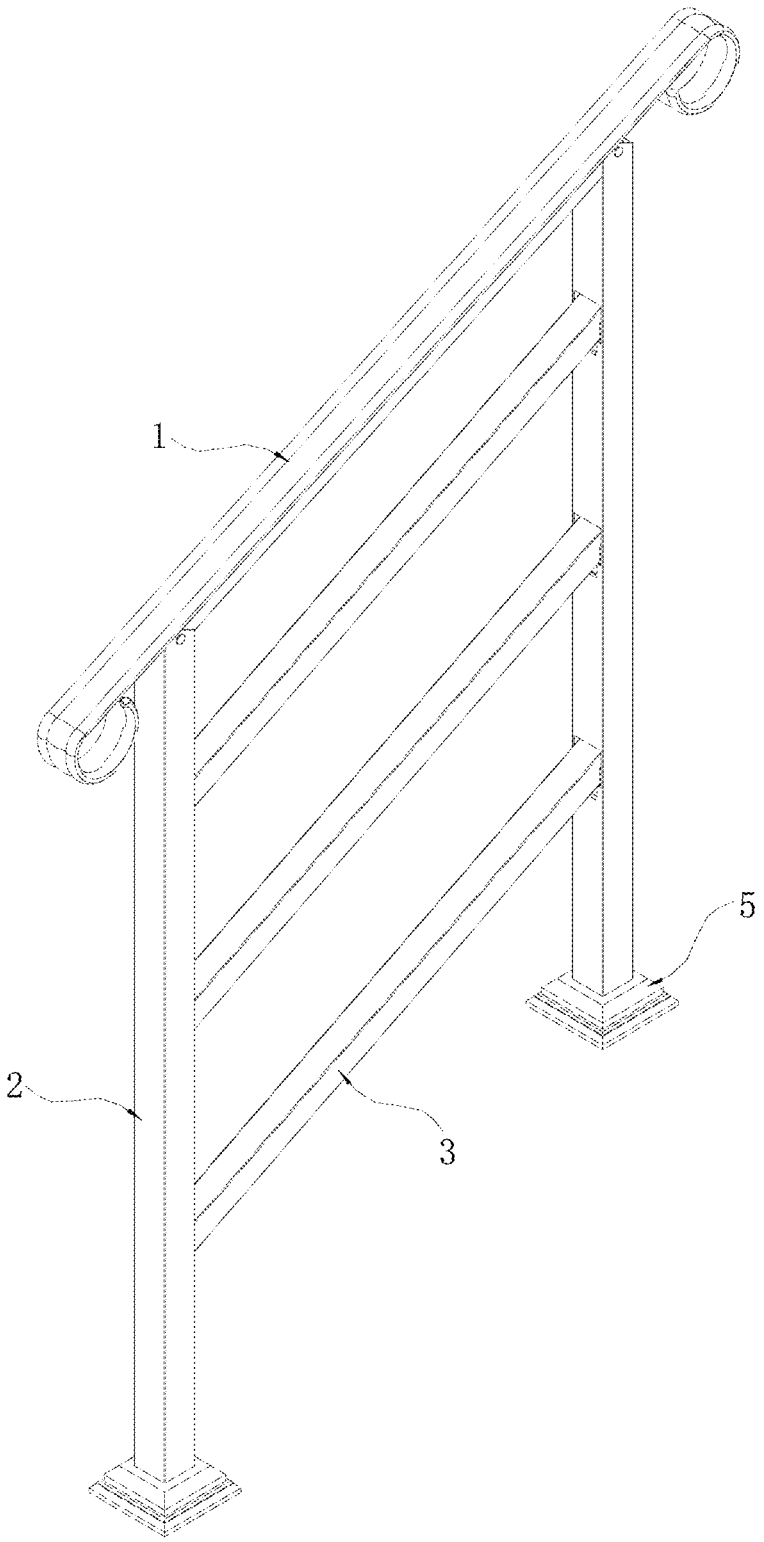
FIG. 17 is a perspective view illustrating a simplified structure of the fifth embodiment of this solution.
Figure 18:
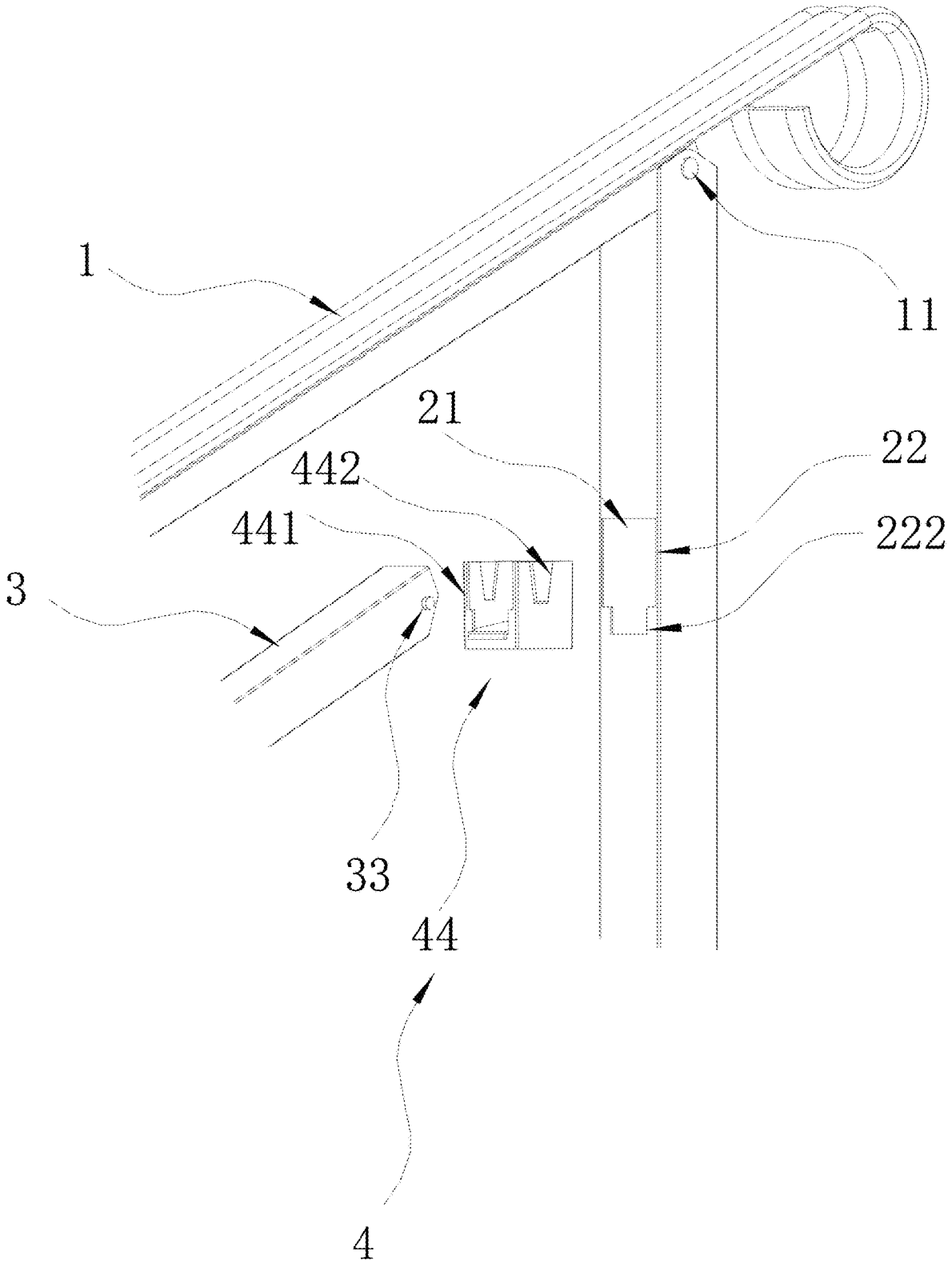
FIG. 18 is an exploded view illustrating the simplified cooperation between the handrail, post, and connecting rod of the fifth embodiment.
Figure 19:
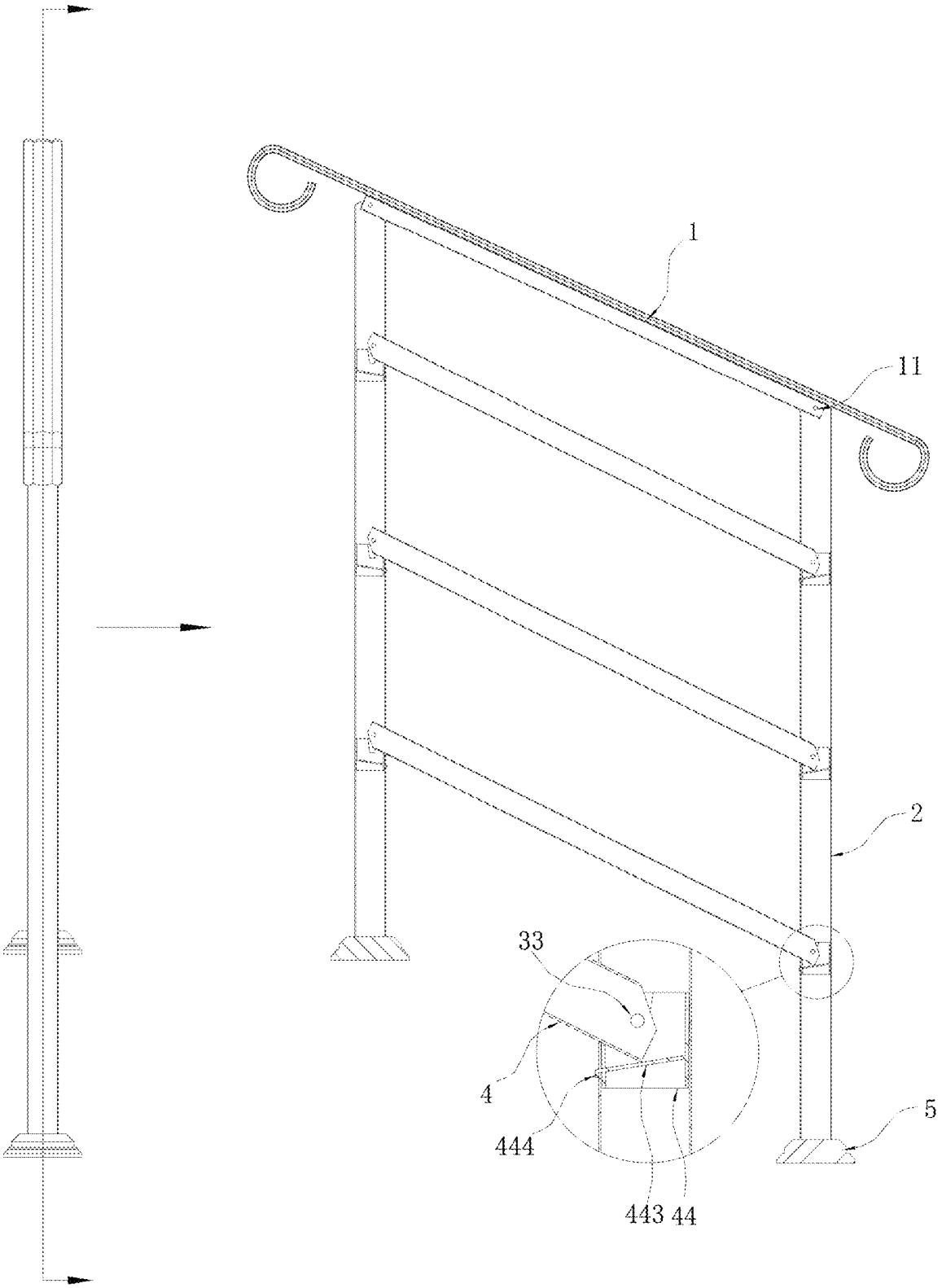
FIG. 19 is a perspective view illustrating another simplified structure of the fifth embodiment of this solution, showing a partial cross-section and enlargement of the connection between the connecting rod and the post.
Figure 20:
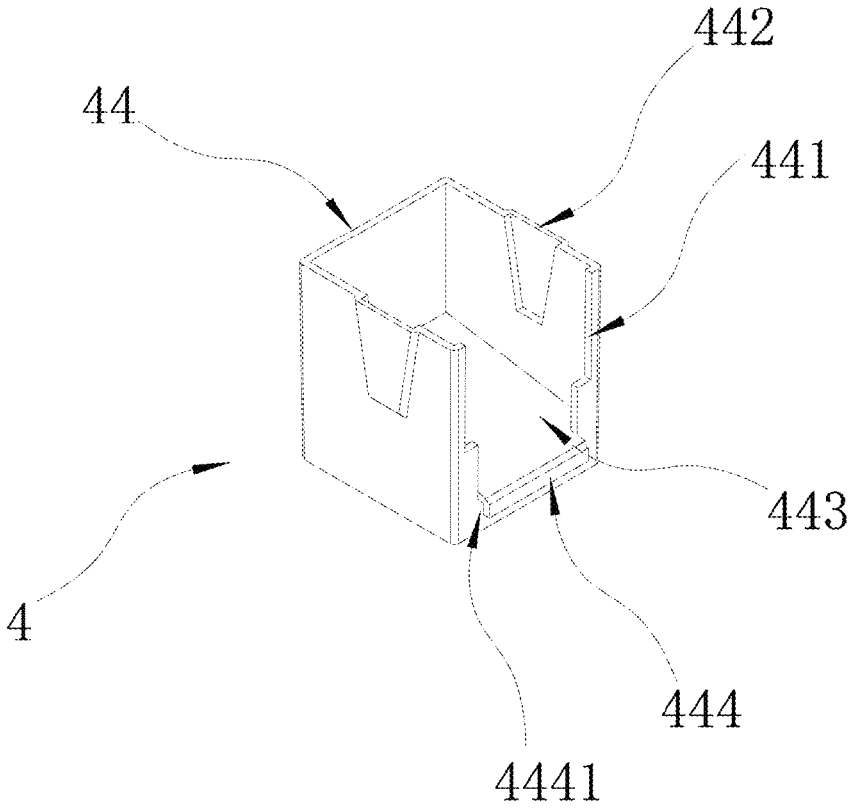
FIG. 20 is a perspective view illustrating the structure of the fifth embodiment when the limit member is a bracket.
Figure 21:
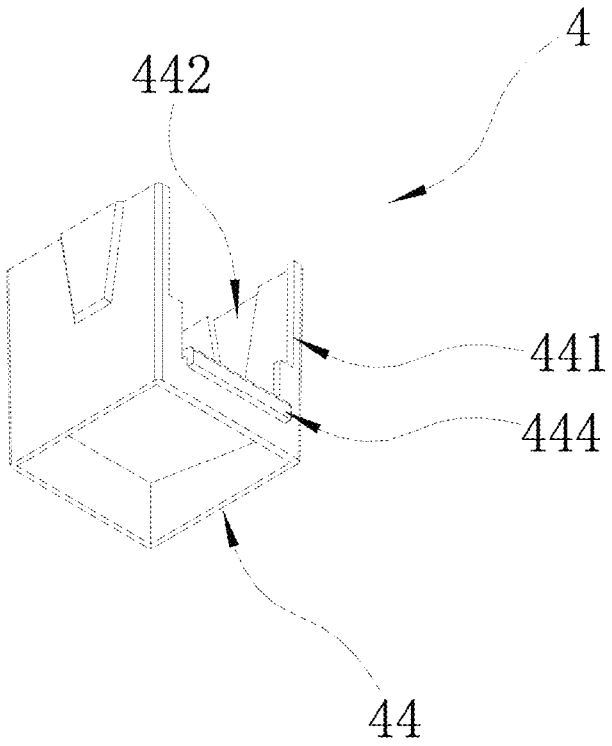
FIG. 21 is a perspective view illustrating the structure of the fifth embodiment when the limit member is a bracket.

Specifically, as shown in FIGS. 14, 15, and 16, the limiting member 4 is a limiting rod 43. The limiting rod 43 is positioned within the end of the connecting rod 3 that enters the constraint section 21, with both ends of the limiting rod 43 extending out from both sides of the connecting rod 3, and both ends being higher than the outer wall of the connecting rod 3.

Correspondingly, the lower part of the clearance opening 22 in the post 2 features a tapered structure 221. The width of the tapered structure 221 is greater than the width of the end of the connecting rod 3 and less than the sum of the width of the end of the connecting rod 3 and the height of the limiting rod 43 above the outer wall of the connecting rod 3. The upper part of the clearance opening 22 in the post 2 has a width greater than the sum of the width of the end of the connecting rod 3 and the height of the limiting rod 43 above the outer wall of the connecting rod 3.

Based on the above structure, during installation, the end of the connecting rod 3 passes through the upper part of the clearance opening 22 into the constraint section 21, with the limiting rod 43 engaging with the tapered structure 221 of the clearance opening 22 located at the lower part of the constraint section 21. That is, as the connecting rod 3 enters the constraint section 21, it is pulled downward by its weight or the force applied by the installer, causing the portion of the limiting rod 43 that protrudes from the side wall of the connecting rod 3 to form a constraint structure, preventing the connecting rod 3 from exiting the constraint section 21. Under this configuration, when the connecting rod 3 is inserted into the constraint section 21, it can rotate within a certain range and also has some axial movement space. This allows the adjustable railing to offer greater adaptability during installation for the connecting rod 3.

Embodiment 5

As shown in FIGS. 17 to 21, this embodiment of the adjustable railing includes a handrail 1 and posts 2. The handrail 1 is arranged either horizontally or at an incline. The posts 2 consist of two or more and are spaced below the handrail 1 along its length. The upper end of the posts 2 is rotatably connected to the underside of the handrail 1, which can be achieved through a pivot 11 or other connecting components. The lower end of the posts 2 connects to an external support (e.g., stairs, ground) to support the handrail 1. The adjustable railing further includes:

One or more connecting rods 3, positioned between adjacent posts 2. Each post 2 is equipped with a constraint section 21 for engaging with the connecting rod 3, which includes a clearance opening 22 located on the post 2 through which the connecting rod 3 passes. Both ends of the connecting rod 3 extend through the clearance openings 22 of the adjacent posts 2 and are movably connected to the constraint section 21 of the posts 2.

Additionally, each end of the connecting rod 3 is connected to a limiting member 4, which prevents the end of the connecting rod 3 from exiting the constraint section 21. When the posts 2 rotate relative to the handrail 1, the connecting rod 3 can rotate around the limiting members 4 at its ends.

To facilitate adaptive adjustment of the connecting rod 3 during railing installation, the connecting rod 3 is arranged parallel to the handrail 1.

Furthermore, as an alternative embodiment, the posts 2 may have a tubular structure; the wall surrounding the clearance opening, the inner cavity, and the portion that accommodates the connecting rod 3 are defined as the constraint section. In this embodiment, the connecting rod 3 has a rectangular tubular structure.

To facilitate the installation of the posts 2 in the usage area, as an alternative embodiment, the bottom of the posts 2 is further equipped with a connection base 5, which is used to secure to an external support, such as the stairs or ground where the railing is installed.

Regarding the number of posts 2 and connecting rods 3, in this embodiment, there are two posts 2 illustrated; the number of connecting rods 3 between adjacent posts 2 is three. However, this embodiment can also accommodate one or two connecting rods between adjacent posts 2. When there are more than two connecting rods 3 between adjacent posts 2, they are arranged with spacing from top to bottom.

Based on the above structure, preferably, the horizontal width of the clearance opening 22 on the posts 2 is greater than the width of the end of the connecting rod 3 and less than the width of the sidewall of the posts 2.

In this embodiment, the limiting member 4 includes:

A bracket 44, which has an open-top box-like structure, fixedly arranged at the lower part of the constraint section 21 of the posts 2. The side of the bracket 44 opposite the clearance opening 22 of the constraint section 21 has a penetration opening 441 for the end of the connecting rod 3 to pass through. The upper part of the bracket 44 has a lap groove 442 that extends upwardly on both sides adjacent to the penetration opening 441, where the lap groove 442 is V-shaped or U-shaped.

Correspondingly, the ends of the connecting rod 3 have raised portions 33 on both sides of the end that penetrate the constraint section 21. The raised portions 33 can be formed by a penetration rod within the connecting rod 3, with the ends of the rod extending out from the connecting rod 3; alternatively, the raised structure can be directly machined or formed on both sides of the end of the connecting rod 3. During installation, the end of the connecting rod 3 enters the upper part of the constraint section 21 through the upper part of the clearance opening 22 and engages with the lap groove 442 through the raised portions 33.

Since the posts 2 have a clearance opening 22 for the connecting rod 3, when the adjustable railing is used outdoors, water may enter through the clearance opening 22, causing water accumulation inside the posts 2 and leading to corrosion and other issues. As a preferable option, the lower part of the bracket 44 is inclined and equipped with a drainage plate 443, which extends downward to the outer side of the penetration opening 441 or beyond.

To facilitate the installation of the bracket, the lower part of the outer side of the bracket 44 with the penetration opening 441 is equipped with a connecting skirt 444. The connecting skirt 444 forms a slot 4441 between itself and the outer side of the bracket 44 with the penetration opening 441. The bracket 44 is fixedly connected to the lower edge of the clearance opening 22 by engaging with the slot 4441, securing the bracket 44 at the lower part of the constraint section 21 of the posts 2.

To facilitate the installation of the bracket 44, the lower edge of the clearance opening 22 is provided with an installation groove 222 that engages with the slot 4441.

Based on the above structure, the adjustable railing can be installed by first pre-assembling the bracket 44 within the constraint section 21 of the post 2. During installation, the end of the connecting rod 3 is inserted through the upper part of the clearance opening 22 into the constraint section 21, and then through the insertion opening 441 of the bracket 44, allowing the raised portion 33 to engage movably with the overlap groove 442. This structural arrangement creates a constraint structure between the raised portion 33 and the overlap groove 442 to prevent the connecting rod 3 from exiting the constraint section 21. Thus, if rainwater enters the constraint section 21 through the clearance opening 22 or falls into the post's constraint section 21 guided by the connecting rod 3, it can be directed out by the water guide plate 443 of the bracket 44, preventing accumulation within the post 2.

The above descriptions are merely part of the embodiments of the present disclosure and do not limit the protection scope. Any equivalent devices or processes derived from the contents of this disclosure specification and accompanying drawings, or applied directly or indirectly in other related technical fields, are also included within the protection scope of this disclosure.

The invention claimed is:

1. An adjustable railing, comprising a handrail and at least two posts; the handrail is arranged horizontally or at an incline; the posts are spaced apart below the handrail along a length direction of the handrail; upper ends of the posts are rotatably connected to a lower side of the handrail; lower ends of the posts are configured to connect to external support structures to support the handrail; the adjustable railing further comprises:

at least one connecting rod; the at least one connecting rod is arranged between adjacent posts; each post has a constraint section for engagement with the at least one connecting rods; the constraint section comprises a clearance opening provided on the post for the at least one connecting rods to pass through; each end of the connecting is respectively inserted through the clearance opening on the adjacent posts and is movably connected to the corresponding constraint section on the post;

wherein each end of the at least one connecting rod is also connected to a limiting member; the limiting member prevents the end of the at least one connecting rod from exiting the constraint section;

the clearance opening has a T-shaped configuration, comprising an upper portion having a greater horizontal dimension than a lower portion.

2. The adjustable railing of claim 1, wherein at least one connecting rod is parallel to the handrail;

when the posts rotate relative to the handrail, the at least one connecting rod is capable of rotating following the limiting members at their ends.

3. The adjustable railing of claim 1, wherein the posts are of a tubular structure; a wall surrounding the clearance opening, an inner cavity, and a portion fitted for the penetration of the at least one connecting rod are defined as the constraint section.

4. The adjustable railing of claim 1, wherein more than two connecting rods are arranged between adjacent posts, the more than two connecting rods are spaced from top to bottom between the adjacent posts.

5. The adjustable railing of claim 1, wherein a horizontal width of the clearance opening is greater than a width of the end of the at least one connecting rod but less than a side-wall width of the post.

6. The adjustable railing of claim 5, wherein the limiting member includes:

a bracket, which is an open-top box structure; fixed at the lower part of the constraint section of the post; the side of the bracket opposite to the clearance opening of the constraint section has a through opening for the end of the at least one connecting rod to pass through; both sides of an upper part of the bracket adjacent to the through opening have upwardly extending slots; the slots are V-shaped or U-shaped;

the end of the at least one connecting rod has raised portions on both sides that pass through the constraint section; the end of the at least one connecting rod enters an upper part of the constraint section through the upper portion of the clearance opening, and engages movably in the slots through the raised portions.

7. The adjustable railing of claim 6, wherein the bracket has one or more of the following structures:

(1) a lower part of the bracket is inclined and has a water guide plate; a lower side of the water guide plate extends to an outer side of the through opening of the bracket or extends beyond the outer side of the through opening;

(2) a lower part of an outer side of the bracket with the through opening has a connecting skirt; a slot is formed between the connecting skirt and the outer side of the bracket with the through opening; the bracket is fixed to a lower part of the constraint section of the post by engaging the skirt with the lower portion of the clearance opening.

* * * * *